US008403698B2

(12) United States Patent
Su et al.

(10) Patent No.: US 8,403,698 B2
(45) Date of Patent: Mar. 26, 2013

(54) CABLE ASSEMBLY WITH AN IMPROVED GROUNDING DEVICE

(75) Inventors: Ping-Sheng Su, New Taipei (TW); Fan-Bo Meng, Kunshan (CN); Qing Wang, Kunshan (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 13/297,205

(22) Filed: Nov. 15, 2011

(65) Prior Publication Data

US 2012/0122334 A1 May 17, 2012

(51) Int. Cl.
*H01R 13/56* (2006.01)

(52) U.S. Cl. ..... 439/455; 439/607.49

(58) Field of Classification Search ..... 439/460, 439/469, 470, 472, 165, 455, 453, 607.49
See application file for complete search history.

(56) References Cited

U.S. PATENT DOCUMENTS

| | | | | |
|---|---|---|---|---|
| 5,594,213 | A * | 1/1997 | Skopic | 174/91 |
| 5,696,351 | A * | 12/1997 | Benn et al. | 174/92 |
| 5,844,171 | A * | 12/1998 | Fitzgerald | 174/92 |
| 7,845,978 | B1 * | 12/2010 | Chen | 439/578 |
| 2006/0194474 | A1 * | 8/2006 | Montena | 439/578 |
| 2011/0143577 | A1 * | 6/2011 | Su et al. | 439/460 |

FOREIGN PATENT DOCUMENTS

CN 201498780 U 6/2010

* cited by examiner

*Primary Examiner* — Neil Abrams
*Assistant Examiner* — Phuongchi Nguyen
(74) *Attorney, Agent, or Firm* — Wei Te Chung; Ming Chieh Chang

(57) ABSTRACT

A cable assembly, comprising a housing, a plurality of conductive terminals received in the housing; a metal shell enclosing the housing; a cable electrically connected to the conductive terminals and a foil. The cable has a number of wires, a braided layer enclosing the wires and an outer insulative pin enclosing the braided layer, each wire has a conductor and an inner insulative pin enclosing the conductor, the braided layer is turned back and encloses a surface of the outer insulative pin. The foil encloses the braided layer which is turned back, and is sandwiched in the metal shell.

5 Claims, 5 Drawing Sheets

CABLE ASSEMBLY WITH AN IMPROVED GROUNDING DEVICE

FIELD OF THE INVENTION

The present invention relates to a cable assembly, and more particularly to a cable assembly with an improved grounding device.

DESCRIPTION OF PRIOR ART

CN Pat. NO. CN201498780U, issued on Jun. 2, 2010, disclosed a cable assembly, which comprises a connector and a cable having a braided layer. The cable is soldered on the connector. The connector comprises a terminal module, a mounting ring installed on the cable, a shielding shell sheltering the terminal module and a front shell enclosing the front end of the terminal module. The mounting ring includes a number of screwed portions and a plurality of riveting portions. The riveting portions and the screwed portions are divided by each other one by one. The shielding shell includes a thread portion. A plurality of screw threads formed on an inner surface of the thread portion. The mounting ring is riveted on the braided layer which is turned back. That the riveting portion of the mounting portion is pressed makes the riveting portion deform for the mounting portion is fastened on the cable. Then, the shielding shell is connected to the mounting ring by both the screwed portion and the screw threads being locked each other. However, the cable assembly with too much components is too complex to be conveniently assembled together and cost down easily.

As discussed above, an improved cable assembly overcoming the shortages of existing technology is needed.

SUMMARY OF THE INVENTION

Accordingly, an object of the present invention is to provide a cable assembly with a metal shell having a simple structure, and the installation processing of the cable assembly is conveniently.

In order to achieve the above-mentioned objects, a cable assembly, comprising a housing, a plurality of conductive terminals received in the housing; a metal shell enclosing the housing; a cable electrically connected to the conductive terminals and a foil. The cable has a number of wires, a braided layer enclosing the wires and an outer insulative pin enclosing the braided layer, each wire has a conductor and an inner insulative pin enclosing the conductor, and the braided layer is turned back and encloses a surface of the outer insulative pin. The foil encloses the braided layer which is turned back, and is sandwiched in the metal shell.

Other objects, features and advantages of the invention will be apparent from the following detailed description taken in connection with the accompanying drawings.

DETAILED DESCRIPTION OF PREFERRED EMBODIMENTS

Figure 1:
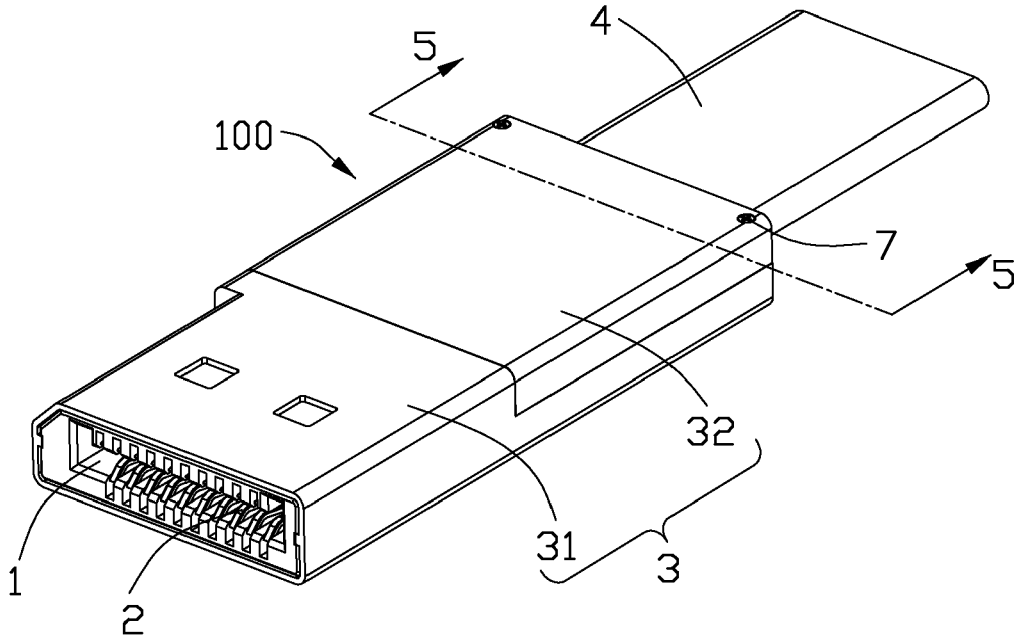
FIG. 1 is a perspective view of a cable assembly in accordance with the present invention.

Reference will now be made to the drawing figures to describe the present invention in detail.

Figure 2:
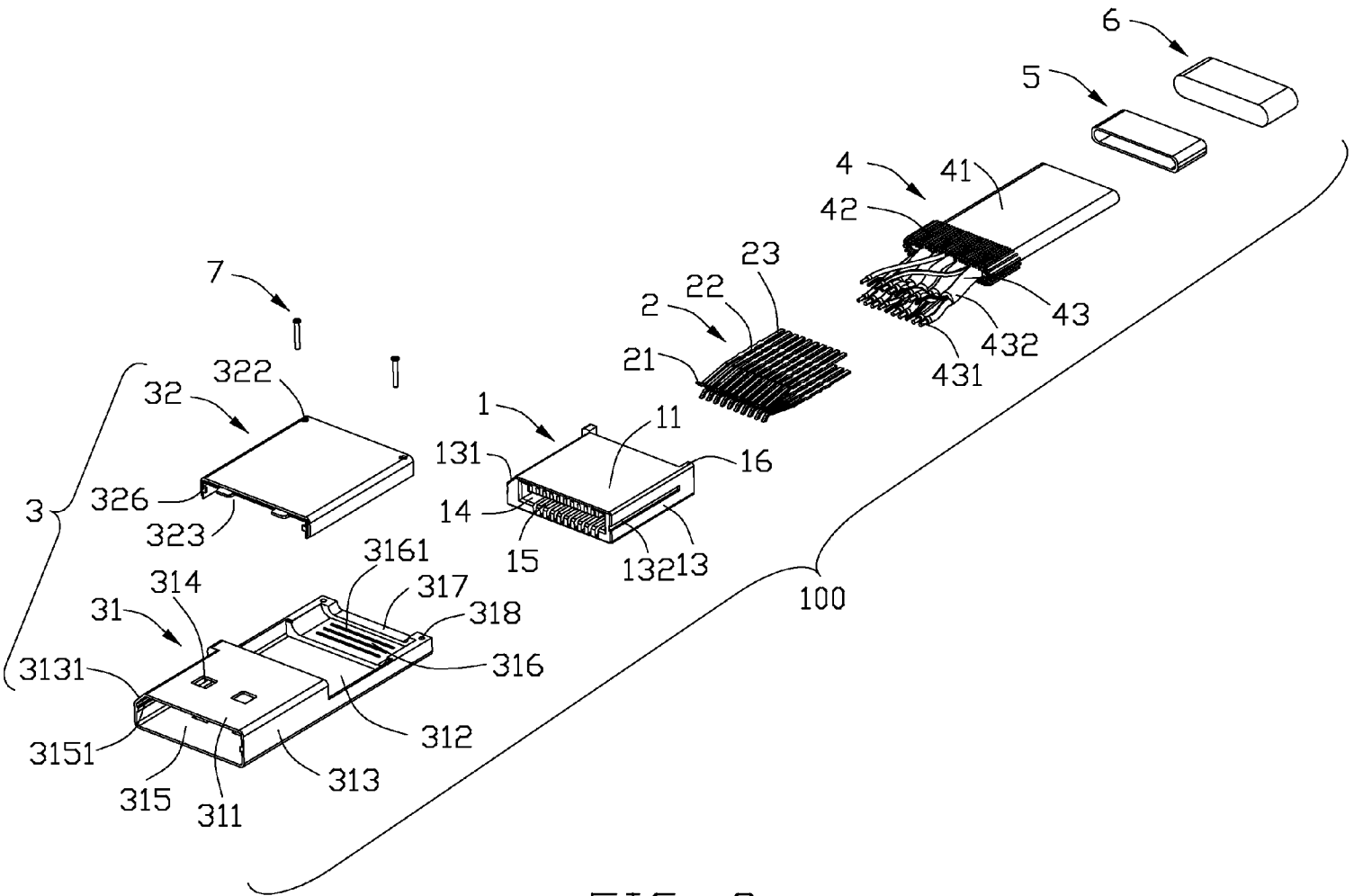
FIG. 2 is an exploded, perspective view of the cable assembly shown in FIG. 1.
Figure 3:
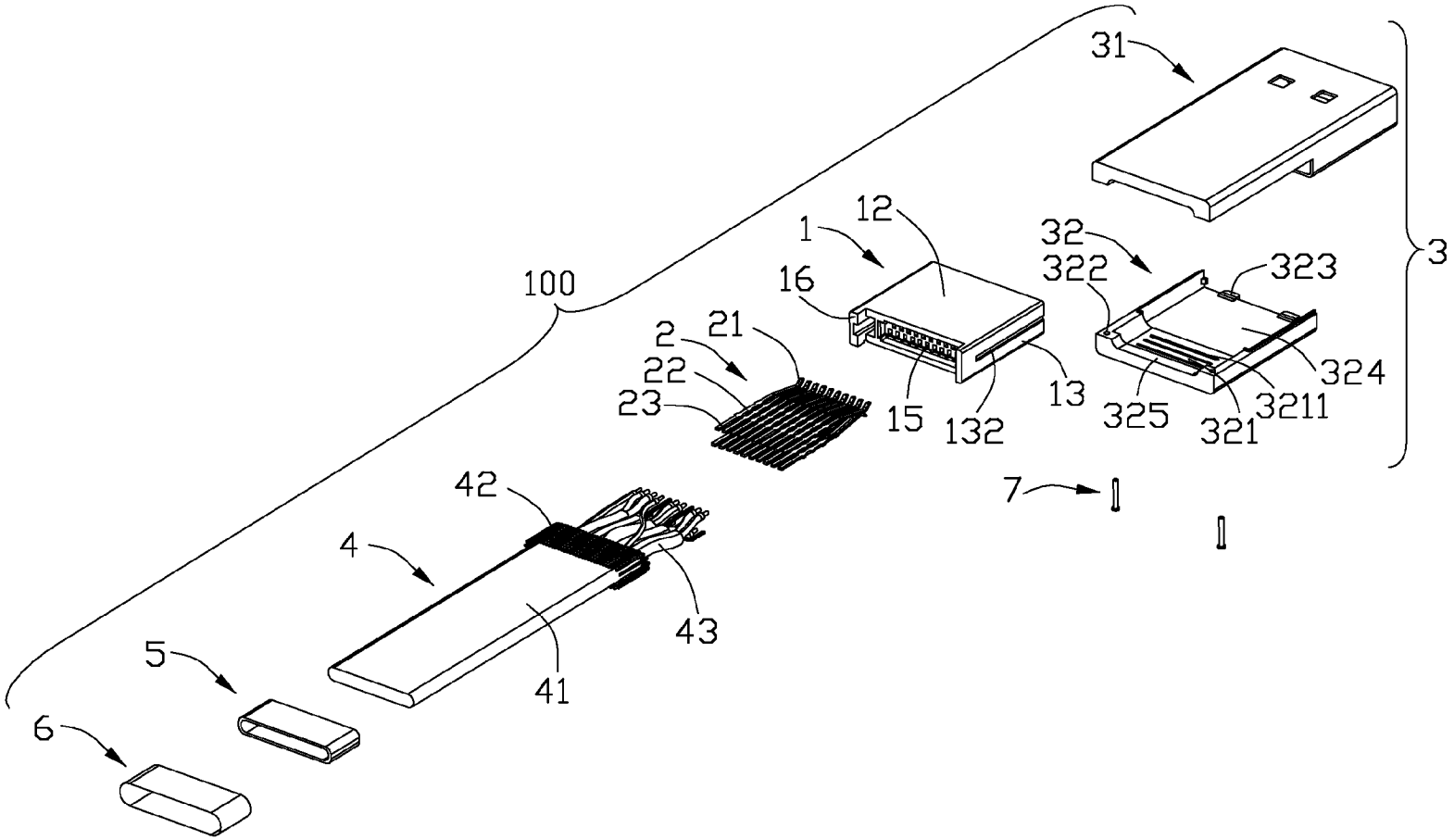
FIG. 3 is a view similar to FIG. 2, but from another aspect.
Figure 4:
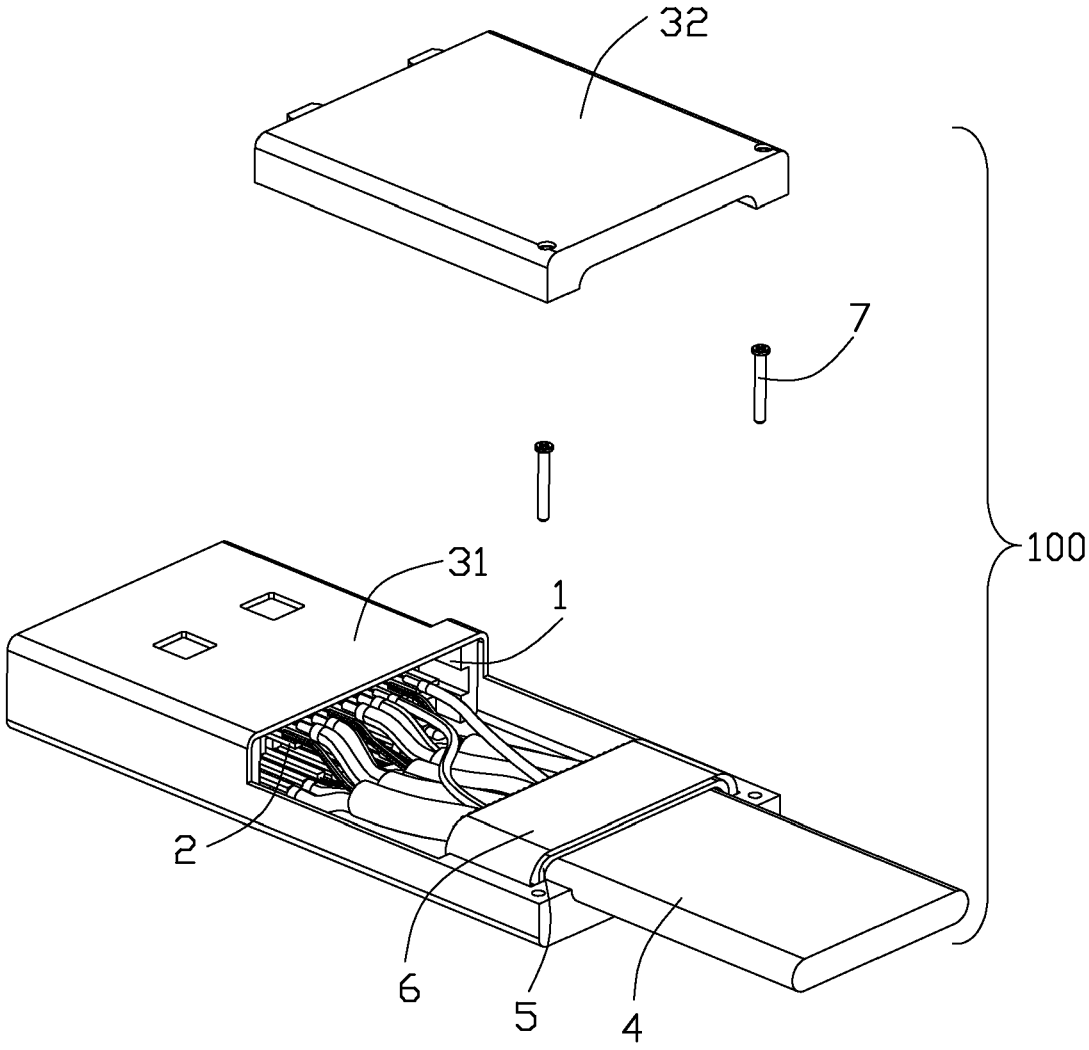
FIG. 4 is a partly assembled, perspective view of the cable assembly shown in FIG. 2.
Figure 5:
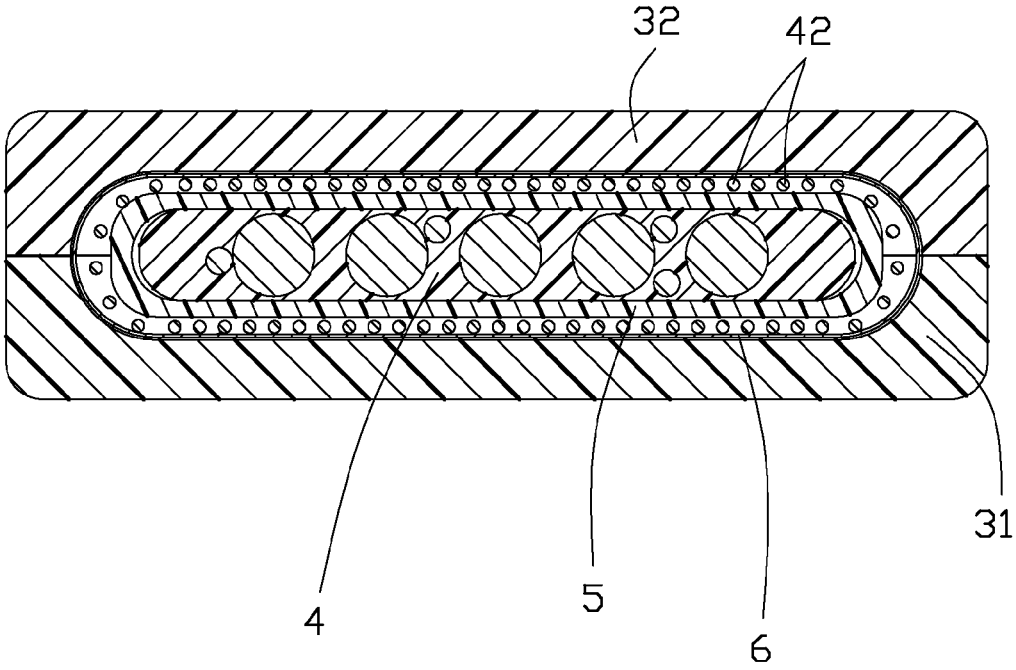
FIG. 5 is a cross-sectional view of the cable assembly shown in FIG. 1 along line 5-5.

Referring to FIGS. 1 to 5, a cable assembly 100 in accordance with the present invention comprises a housing 1, a plurality of conductive terminals 2 received in the housing 1, a cable 4 electrically connected to the conductive terminals 2, a metal shell 3 enclosing the housing 1, a strain relief portion 5 molded on the cable 4 and a foil 6. The cable 4 has a braided layer 42 enclosed in the foil 6.

The housing 1 comprises an upper wall 11, a lower wall 12 opposite to the upper wall 11 and a pair of lateral walls 13 connected to the upper wall 11 and the lower wall 12. One of lateral walls 13 defines a slant 131. A receiving cavity 14 is recessed rearwardly from a front surface for mating to a complementary connector (not shown). A plurality of receiving passageways 15 are defined respectively on the upper wall 11 and the lower wall 12, and communicated with the receiving cavity 14. The receiving passageways 15 are passing through a rear surface of the housing 1. A pair of slits 132 are recessed inwardly from an outer surface of the lateral wall 13 along a mating direction of the cable assembly 100, respectively. A pair of supporting portions 16 are respectively located behind the lateral walls 13.

The conductive terminals 2 are arranged in two rows. Each conductive terminal 2 comprises a flat main portion 22, a touching portion 21 extending bendly forwardly from the main portion 22 and an ending portion 23 extending rearwardly from the main portion 22.

In this embodiment, The metal shell 3 comprises a lower shell 31 and an upper shell 32 installed on the lower shell 31. In other embodiments, the metal shell 3 may be an integrated structure. The lower shell 31 is made of metal material (e.g. Zinc Alloy) and comprises an upper wall 311 and a lower wall 312 opposite to the upper wall 311 and a pair of lateral walls 313 connected to the upper wall 311 and the lower wall 312. One of lateral walls has a slant portion 3131. Both the upper wall 311 and the lower wall 312 define two pairs of mating holes 314. The upper wall 311 and the partly lateral wall 313 located on a rear end of the lower shell 31 are recessed for the rear end of the lower shell 31 being an opening structure by three walls surrounding and the front end of the lower shell 31 being a closed structure by four walls surrounding. A receiving space 315 is recessed rearwardly from a front surface of the lower shell 31. A pair of ribs 3151 are located in the receiving space 315 for corresponding to the slits 132 of the housing 1. The lower shell 31 defines also a lower groove 316 recessed downwardly from the rear end thereof and a gap 317 located behind the lower groove 316. a pair of retaining holes 318 are defined on the rear end of the lower shell 31. A convex 3161 is raised upwardly from an inner lower surface of the lower groove 316. The gap 317 is passing through a rear surface of the lower shell 31.

The upper shell 32 is of U-shaped and made of metal material by stamping. The upper shell 32 comprises an upper groove 321 located on a rear end thereof and recessed upwardly from an inner surface thereof. A pair of retaining holes 322 are through the upper shell 32. A pair of holding portions 323 are extended forwardly from a front end of the upper shell 32. A pair of supporting ribs 326 are located on two sides of the upper shell 32. A convex 3211 is raised downwardly from an inner lower surface of the upper groove 321. The upper shell 32 defines also a recessing portion 324 located at front of the upper groove 321. The depth of the recessing portion 324 is deeper than the depth of the upper groove 321.

The cable 4 is flat and comprises a set of wires 43, an outer insulative pin or outer insulator 41 enclosing the braided layer 42. The wires 43 are enclosed in the braided layer 42. Each wire 43 defines a conductor 431 and an inner insulative pin or inner insulator 432 enclosing the conductor 431. The braided layer 42 is exposed on a front end of the outer insulative pin 41, and the inner insulative pin 432 is exposed on a front end of the braided layer 42, and the conductor 431 of the wire 43 is exposed on a front end of the inner insulative pin 432.

The foil 6 is made of copper material. Of course, in other embodiments, the material can be aluminum, zinc or other metal materials. The surface of the foil 6 has transmission function. The cable assembly also defines a locking member 7 for locking the upper shell 32 and the lower shell 31.

In assembly, the housing is molded on the conductive terminals, the main portion 22 and the touching portion 21 are received in the passageway 15 of the housing 1. A front end of the touching portion 21 is exposed out of the passageways 15 for mating a conductive terminal (not shown) of the complementary connector. The ending portion 23 is beyond a rear end of the housing 1. The strain relief portion 5 is molded the front end of the cable 4 for protecting the cable 4 from being broken. The braided layer 42 which is exposed the front end of the outer insulative pin 41 is turned back for let the strain relief portion 5 be sandwiched the outer insulative pin 41 and the braided layer 42. The foil 6 encloses the braided layer 42. The conductor 431 is soldered on the ending portion 23 for the cable 4 electrically connecting to the conductive terminal 2.

The housing 1 is assembled in the receiving space 315 from the rear end of the lower shell 31 along a front-to-rear direction. The ribs 3151 are received in the slits 132. A rear end of the rib 13 is attached to a rear end of the slits 132 to make the housing 1 being not put out of the receiving space 315. The foil 6 and the strain relief portion 5 are received in the lower groove 316, and the foil 6 is located on the convex 3161 in the lower groove 316. The wires 43 on the front of the braided layer 42 are received in the receiving space 315. The upper shell 32 is assembled on the rear end of the rear shell 31. The holding portions 323 are located in the receiving space 315 and attached to the rear surface of the housing 1. The supporting ribs 326 are attached to the supporting portions 16 for the housing 1 being not fallen back. The locking holes 322 on the upper shell 32 are alignment to the locking holes 318 on the lower shell 31. The convexes 3211 of the upper groove 321 presses the foil 6. The convexes 3211, 3161 sandwich the foil 6 for the foil 6 connecting to the metal shell 3. The upper grooves 321, 316 of the upper shell 32 and the lower shell 31 are integrated with a receiving groove. The foil 6 is attached to an inner surface of the receiving groove. The strain relief portion 5 the front and rear surface of the receiving groove for protecting the cable 4. The outer insulative pin 41 of the cable 4 is received in the gap of the metal shell 3. The locking member 7 is assembled in the locking holes 318, 322 for retaining the upper shell 32 and the lower shell 31. The outer surface of the upper shell 32 and alignment to the outer surface of the lower shell 31.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A cable assembly, comprising:

a housing;

a plurality of conductive terminals received in the housing;

a metal shell enclosing the housing;

a cable electrically connected to the conductive terminals and having a number of wires, a braided layer enclosing the wires and an outer insulative pin enclosing the braided layer, each wire having a conductor and an inner insulative pin enclosing the conductor, the braided layer turned back and enclosing on a surface of the outer insulative pin; and a foil enclosing the braided layer which is turned back, and sandwiched in the metal shell;

wherein a receiving groove is defined in a rear end of the metal shell for receiving the foil;

wherein an outer surface of the foil is attached to an inner surface of the receiving groove;

wherein the metal shell defines a lower shell and an upper shell assembled on the lower shell;

wherein the receiving groove is composed of a upper groove of the upper shell and a lower groove of the lower shell;

wherein a front end of the lower shell is composed of a closed structure by four walls for receiving the housing;

wherein a rear end of the lower shell is composed of an open structure by three walls for assembling on the upper shell;

wherein at least a convex is raised on an inner lower surface of the upper shell and the lower shell, respectively;

wherein the convexes of the upper shell and the lower shell sandwich the foil;

wherein the cable assembly further comprises a strain relief portion molded on the outer insulative pin of the cable and located between the braided layer which is turned back and the outer insulative pin;

wherein the foil encloses the strain relief;

wherein the cable is a flat cable;

wherein the braided layer is backwardly folded upon the strain relief, and the foil encloses the backward folded braided layer in sequence, wherein the foil and the backwardly folded braided layer, the strain relief and the cable are commonly received within the grooves of upper and lower shells.

2. The cable assembly as recited in claim 1, wherein a surface of the upper shell is alignment to an upper surface of the lower shell.

3. The cable assembly as recited in claim 1, wherein the cable assembly further comprises a pair of locking members.

4. The cable assembly as recited in claim 3, wherein the upper shell and the lower shell defines a pair of locking holes for receiving respectively the locking member to make the upper shell and the lower shell retain together.

5. A cable connector assembly comprising:

an insulative housing defining a front mating port and a rear connection port;

a plurality of contacts disposed in the housing with front contacting sections exposed in the front mating port and rear connecting sections exposed in the connecting port;

a flat cable having an outer insulator enclosing a plurality of wires connected to the connecting sections of the corresponding contacts, respectively, under condition that a braiding layer is sandwiched between the outer insulator and the wires;

a strain relief integrally formed circumferentially upon a front end region of the outer insulator; and a metallic shell enclosing the housing and front portions of the wires and including assembled upper and lower shells each defining a groove therein; wherein a front end section of the braiding layer extends beyond a front end of the outer insulator and is folded backward to be applied circumferentially upon the strain relief so as to cooperate with the outer insulator to sandwich the strain relief therebetween, and a metal foil circumferentially encloses the backward folded front section of the braiding layer under condition that said metal foil is intimately sandwiched between the metallic shell; wherein the groove is equipped with a plurality of protruding structures to contact the metal foil;

wherein a front end of the lower shell is composed of a closed structure by four walls for receiving the housing;

wherein a rear end of the lower shell is composed of an open structure by three walls for assembling on the upper shell;

wherein a surface of the upper shell is alignment to an upper surface of the lower shell;

wherein the cable is a flat cable;

wherein the metal foil and the backwardly folded braiding layer, the strain relief and the cable are commonly received within the grooves of the upper and lower shells.

* * * * *